US007569097B2

(12) United States Patent
Campen et al.

(10) Patent No.: US 7,569,097 B2
(45) Date of Patent: Aug. 4, 2009

(54) SUBSEA MULTIPHASE PUMPING SYSTEMS

(75) Inventors: Clifford Howard Campen, Pittsburgh, PA (US); Jose Luis Matos, Pittsburgh, PA (US); James Roncace, Murrysville, PA (US)

(73) Assignee: Curtiss-Wright Electro-Mechanical Corporation, Cheswick, PA (US)

( * ) Notice: Subject to any disclaimer, the term of this patent is extended or adjusted under 35 U.S.C. 154(b) by 337 days.

(21) Appl. No.: 11/442,690

(22) Filed: May 26, 2006

(65) Prior Publication Data

US 2007/0274842 A1 Nov. 29, 2007

(51) Int. Cl.
*B01D 19/00* (2006.01)

(52) U.S. Cl. ..... 95/243; 95/261; 96/207; 96/209; 166/357; 166/267; 166/105.5; 417/313

(58) Field of Classification Search ..... 95/261, 95/243; 96/207, 209; 166/357, 267, 105.5, 166/265; 417/313
See application file for complete search history.

(56) References Cited

U.S. PATENT DOCUMENTS

| | | | | |
|---|---|---|---|---|
| 2,489,887 | A | 11/1949 | Houghton | |
| 4,913,630 | A | 4/1990 | Cotherman et al. | |
| 5,044,440 | A | 9/1991 | Stinessen et al. | |
| 5,259,741 | A | 11/1993 | Nitta | |
| 5,478,504 | A | 12/1995 | de Almeida Barbuto | |
| 5,526,684 | A | 6/1996 | Liu et al. | |
| 5,624,249 | A | 4/1997 | Rohlfing | |
| 5,738,505 | A | 4/1998 | Mezzedimi et al. | |
| 5,775,879 | A | 7/1998 | Durando | |
| 5,795,135 | A | 8/1998 | Nyilas et al. | |
| 5,871,340 | A | 2/1999 | Hatton | |
| 6,007,306 | A | 12/1999 | Vilagines | |
| 6,059,539 | A | 5/2000 | Nyilas et al. | |
| 6,082,452 | A | 7/2000 | Shaw et al. | |
| 6,135,723 | A | 10/2000 | Hatton | |
| 6,234,030 | B1 * | 5/2001 | Butler | 73/861.04 |
| 6,354,318 | B2 | 3/2002 | Butler | |
| 6,457,950 | B1 * | 10/2002 | Cooper et al. | 417/366 |
| 6,651,745 | B1 | 11/2003 | Lush et al. | |
| 6,860,921 | B2 | 3/2005 | Hopper | |
| 7,013,978 | B2 | 3/2006 | Appleford et al. | |
| 2001/0011556 | A1 | 8/2001 | Butler | |
| 2003/0159581 | A1 | 8/2003 | Sanderford et al. | |
| 2004/0099422 | A1 | 5/2004 | Lush et al. | |
| 2005/0061515 | A1 | 3/2005 | Hopper | |
| 2005/0145388 | A1 | 7/2005 | Hopper | |
| 2005/0150827 | A1 | 7/2005 | Hopper | |

* cited by examiner

*Primary Examiner*—Duane Smith
*Assistant Examiner*—Douglas J Theisen
(74) *Attorney, Agent, or Firm*—Reed Smith LLP

(57) ABSTRACT

In subsea multiphase pumping systems, the use of a gas-liquid cylindrical cyclone (GLCC) as a separator to recirculate liquid from pump discharge to pump suction, especially during high gas inlet conditions from a multiphase petroleum stream. Further contemplated is protection of the pump from momentary high gas inlet conditions due to an incoming slug flow profile from a petroleum stream, via transforming a naturally varying multiphase petroleum stream into separated phases for measured distribution to the pump suction and ensuring a minimum liquid flow.

61 Claims, 5 Drawing Sheets

SUBSEA MULTIPHASE PUMPING SYSTEMS

FIELD OF THE INVENTION

The present invention generally relates to subsea multiphase pumping systems and related equipment, for instance, as employed in the petroleum industry. More particularly, the present invention relates to twin-screw and/or positive displacement pumps in the contents just mentioned.

BACKGROUND OF THE INVENTION

As generally known, a subsea multiphase pump, particularly as employed in marine-based oil fields, is typically configured for pumping a combination of petroleum, water, natural gas, and, at times, small particulates (such as sand). Typically, a "pump suction flow," in the form of a fluid mixture of liquid, gas and solids, travels through the production flow line to the multiphase pump. The pump thus actually pumps a combination of pump suction flow along with any recirculated liquid from the pump discharge.

Twin-screw multiphase pumps have been demonstrated to work admirably in petroleum applications. However, such pumps require a minimum of liquid in the multiphase mixture to maintain a seal between the screw flanks and the screw tips and casing, which requires careful attention in the detailed systems design.

In multiphase service, when this liquid minimum is not present, the pump ceases to pump but still continues to rotate, thus defeating the purpose of the installation. In a subsea installation, the cost of the pumping system is high enough that the loss of production with no boost represents a substantial loss of revenue.

Additionally, when the pump ceases to produce flow against a pressurized discharge line, the liquid in the discharge tends to leak back into the pump. This heated liquid is continuously "regurgitated", maintaining pump head but not generating any pump flow. The power used to compress gas, which also is regurgitated to the pump suction, will heat the liquid phase and the pump rotors. The heat will remain in the absence of a mass flow, and the pump can thus be damaged if it is not shut down.

In oil fields in particular, there is generally some uncertainty about the size of gas "slugs" that naturally occur in the flowing multiphase oil and gas mixture. Loss of liquid for short periods of time (e.g., fractions of a second) is sufficient to cause the pump to cease pumping even though it continues to run. The transport time for a fluid element, between entering the pump screw entrances and exiting the pump is typically 5-8 revolutions, or typically 0.16-0.27 second for a pump operating at 1800 rpm).

A "GLCC", or Gas Liquid Cylindrical Cyclone, provides an arrangement for separating gas and liquid from a multiphase mixture. This technology utilizes a vessel with a tangential inlet to form a vortex. Separation of the multiphase fluid occurs due to centrifugal, gravitational and buoyancy forces. Known arrangements abound (see, e.g., U.S. Pat. No. 5,526,684 to Chevron). Typically, a GLCC will be interposed between a pump and an outlet line.

A common approach to ensuring continuous liquid flow, when this is not the norm in an oil field flow line, is to employ recirculation. In recirculation, liquid is separated in the discharge of the pump and some portion of it, e.g. ~5% of the pump's full volumetric flow regardless of speed, is throttled back to the pump suction. This same liquid can be reseparated at the pump discharge, while the pump can continue to pump and compress an incoming single-phase gas slug indefinitely.

Any recirculation, of course, detracts from pump efficiency in that the liquid recirculated reduces the capacity of the pump, and volumetric efficiency is thus reduced. Additionally, work is required to pump the recirculated fluid back to the discharge pressure condition. In effect, the need for recirculation normally presents a requirement for more energy and a larger pump to do a particular job.

Gas that is entrained with the recirculation liquid is even worse for pump performance. The gas expands upon exiting the recirculation-throttling device, and as a result reduces the volume of suction flow by a factor corresponding to the pressure ratio times its volume at discharge pressure. In effect, 1 cu. ft of gas that is carried under with the liquid phase, and which is recirculated can become 5-6 cu. ft at suction conditions, depending on the pressure ratio across the pump. Additionally, compressive work has to be performed on this gas to recompress it to discharge conditions. Consequently, a need exists to provide good efficiency in limiting free gas (vs. gas in solution) from the liquid being recirculated.

However, several provisions typically need to be addressed. For one, recirculated liquid is typically heated by the compression of the gas during multiphase operation and therefore increases the pump suction temperature. In the event that the only incoming fluid is gas, then sufficient mass flow to remove the heat will not be present and the recirculated liquid will heat up. If liquid does not reach the pump, this heating process goes forward continuously until the pump is damaged or automatically shut down based on the discharge temperature.

Additionally, the discharge separation presents an efficiency in separating the liquid from the gas. For instance, in a GLCC, liquid that is entrained with the gas flow goes out of a GLCC at the recombination point and is lost out the discharge flow line; this is known as liquid carryover. A separator with good efficiency minimizes this loss of liquid. The larger the volume of liquid that can be retained in the recirculation vessel (or vessels attached to the recirculation vessel), the longer the system can stay in operation without running out of liquid or overheating.

Further, since the liquid phase carries the particulates (typically sand and rust), if sufficient velocity of the liquid is not maintained through the separator then these particulates tend to settle out of the liquid and accumulate. Once they have sufficiently accumulated, they can be recirculated in higher concentrations through the pump either as a result of transients (stop-starts) or of just having the natural accumulation collapse into the recirculation line. Typical topside systems have cleanout ports to keep this from happening, but this is undesirable for subsea systems where intervention is limited or difficult. Accordingly, subsea systems typically need to employ liquid velocities high enough to keep particulates in suspension during all times of normal operation.

In view of the foregoing, a compelling need has been recognized in connection with resolving the issues framed above with regard to pump recirculation.

From another standpoint, naturally occurring flow in a multiphase pipeline produces a variety of flow profiles, such as annular, wave and "slug" flow profiles. Slug flow, for its part, is represented by alternating volumes of gas and oil. For a given line size, gas volume, liquid density, liquid viscosity and pressure, these slugs tend to present a recurring pattern and accordingly form waves with a natural frequency and a shape for the liquid and gas phases. These waves exhibit a variability that can be characterized in frequency with a mean and standard deviation (although these properties are rarely known explicitly).

If the production pipeline or local pump connections experience abrupt changes in elevation, however, the wave variability can change adversely such that the liquid slugs will resemble a periodic square wave with little liquid in the leading and trailing edges of each slug. In this and other cases, slugs can thus end up presenting fluid to the pump as only a gas phase, or at least as a gas phase with a liquid content lower than the minimum required to provide a seal.

Consequently, if such gas-dominated slugs are long in duration (at least long enough for a slug to pass through the pump, or likely fractions of a second) then the pump will lose "prime". Because the pumping systems at hand typically run continuously with slug periods in the 2-10 second range, a large population of slugs are normally generated in continuous operation. As a consequence, examples of the entire population of plus or minus 3-sigma slugs are experienced frequently (e.g., daily) and even examples 6-sigma slugs are experienced periodically (e.g., monthly).

As such, failure of the incoming flow to contain a minimum amount of liquid, e.g. ~5% of the full flow rating of the pump, can result in a loss of prime and, thus, flow stagnation and heat-up issues within the pump as mentioned further above.

A conventional countermeasure involves the provision of temperature sensors and, in that connection, automatic pump shutdown protection. While this indeed proves to be an effective measure for protecting the pump, overall operability and efficiency still remain major issues, since unplanned pump shutdowns will clearly result in upsets to production and processing facilities. Restarting the pump, flow line, and other components, potentially can take several hours and require other resources such as gas lift and MEG (Mono-Ethylene Glycol) injection.

In view of the above problems, strides have indeed been made towards minimizing or eliminating the loss of prime events in twin-screw multiphase pump operation, albeit with less than optimal results. The use of liquid recirculation, as discussed further above, has proven to be effective, while presenting disadvantages. Another approach involves separating the liquid in the suction and metering it into the pump. If the capacity of such a separator is large enough, the pump can end up traversing long periods where the liquid in the incoming fluid satisfies the ~5% threshold by combining liquid retained in the separator with the incoming fluid stream. In subsea applications however, larger tanks and separate metering pumps can be impractical to implement because of weight constraints and the desire to avoid complexity and increase reliability. A practical suction separator for subsea use can be designed to handle variations in the incoming slug flows, if the design scope is limited to the variation anticipated by the pump capacity and well yield. For situations where there is no correlation to pump capacity and well production, such as start-up or system upsets, the recirculation system has to be used.

Accordingly, in view of the foregoing, yet another compelling need has been recognized in connection with implementing a more efficient and cost-effective solution in connection with liquid slug management and distribution.

SUMMARY OF THE INVENTION

There is broadly contemplated herein, in accordance with at least one presently preferred embodiment of the present invention, a recirculation system for subsea multiphase pumps, in the context of a GLCC. Preferably included is a baffle plate or analogously functioning device in a recombination vessel of a GLCC.

Additionally, there is broadly contemplated herein, in accordance with at least one presently preferred embodiment of the present invention, an arrangement for providing a continuous minimum liquid flow into pump suction via the use of a tangential inlet into a cylindrical "slug distributor" vessel. Preferably, the vessel further includes a perforated plate, breather tubes, a standpipe and metering holes at the bottom of the vessel to deliver liquid flow at a metered rate to the pump inlet.

In a particularly preferred embodiment of the present invention, a subsea multiphase pumping system will include salient aspects of both of the broadly defined implementations discussed just above (i.e., the recirculation arrangement and the slug distribution arrangement).

In summary, there is broadly contemplated herein, in accordance with at least one presently preferred embodiment of the present invention, a multiphase pumping system for subsea operation, the system comprising: a pump; a flow inlet for accepting incoming multiphase flow and directing incoming multiphase flow generally towards the pump; a flow outlet for directing outgoing multiphase flow generally away from the pump; a flow management apparatus in fluid communication with the pump and at least one of the flow inlet and the flow outlet; the flow management apparatus acting to ensure a minimum liquid content in multiphase flow entering the pump; the flow management apparatus comprising: a gas liquid cylindrical cyclone in communication with the flow outlet; a recirculation port disposed in the gas liquid cylindrical cyclone; and a recirculation line in communication with the recirculation port, the recirculation line acting to direct flow generally towards the pump.

Further, there is broadly contemplated herein, in accordance with at least one presently preferred embodiment of the present invention, a multiphase pumping system for subsea operation, the system comprising: a pump; a flow inlet for accepting incoming multiphase flow and directing incoming multiphase flow generally towards the pump; a flow outlet for directing outgoing multiphase flow generally away from the pump; a flow management apparatus in fluid communication with the pump and at least one of the flow inlet and the flow outlet; the flow management apparatus acting to ensure a minimum liquid content in multiphase flow entering the pump; the flow management apparatus comprising: a liquid slug distributor; the liquid slug distributor comprising an inlet and an outlet, the outlet being in communication with the pump; the liquid slug distributor acting to regulate gas slugs incoming from the inlet in a manner to ensure propagation, through the outlet, of a minimum liquid content in multiphase flow.

Additionally, there is broadly contemplated herein, in accordance with at least one presently preferred embodiment of the present invention, a gas liquid cylindrical cyclone for a multiphase pumping system for subsea operation, the gas liquid cylindrical cyclone comprising a recirculation port for communicating with a pump.

Moreover, there is broadly contemplated herein, in accordance with at least one presently preferred embodiment of the present invention, a liquid slug distributor for a multiphase pumping system for subsea operation, the liquid slug distributor comprising: an inlet; and an outlet for communicating with a pump; the liquid slug distributor acting to regulate gas slugs incoming from the inlet in a manner to ensure propagation, through the outlet, of a minimum liquid content in multiphase flow.

Furthermore, there is broadly contemplated herein, in accordance with at least one presently preferred embodiment of the present invention, a method of providing multiphase pumping in subsea operation, the method comprising: providing a pump; accepting incoming multiphase flow and directing incoming multiphase flow generally towards the pump; directing outgoing multiphase flow generally away from the pump; ensuring a minimum liquid content in multiphase flow entering the pump; the step of ensuring a minimum liquid content comprising: providing a gas liquid cylindrical cyclone; and recirculating at least a portion of liquid flow in the gas liquid cylindrical cyclone generally towards the pump.

The novel features which are considered characteristic of the present invention are set forth herebelow. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

The present invention and its presently preferred embodiments will be better understood by way of reference to the detailed disclosure herebelow and to the accompanying drawings, wherein.

DETAILED DESCRIPTION OF THE PREFERRED EMBODIMENTS

As broadly employed herein, it should be understood and appreciated that the term "fluid" can refer to a liquid, a gas, a mixture or suspension thereof, or a mixture or suspension of liquid and/or gas with solid material such as particulates.

Figure 1:
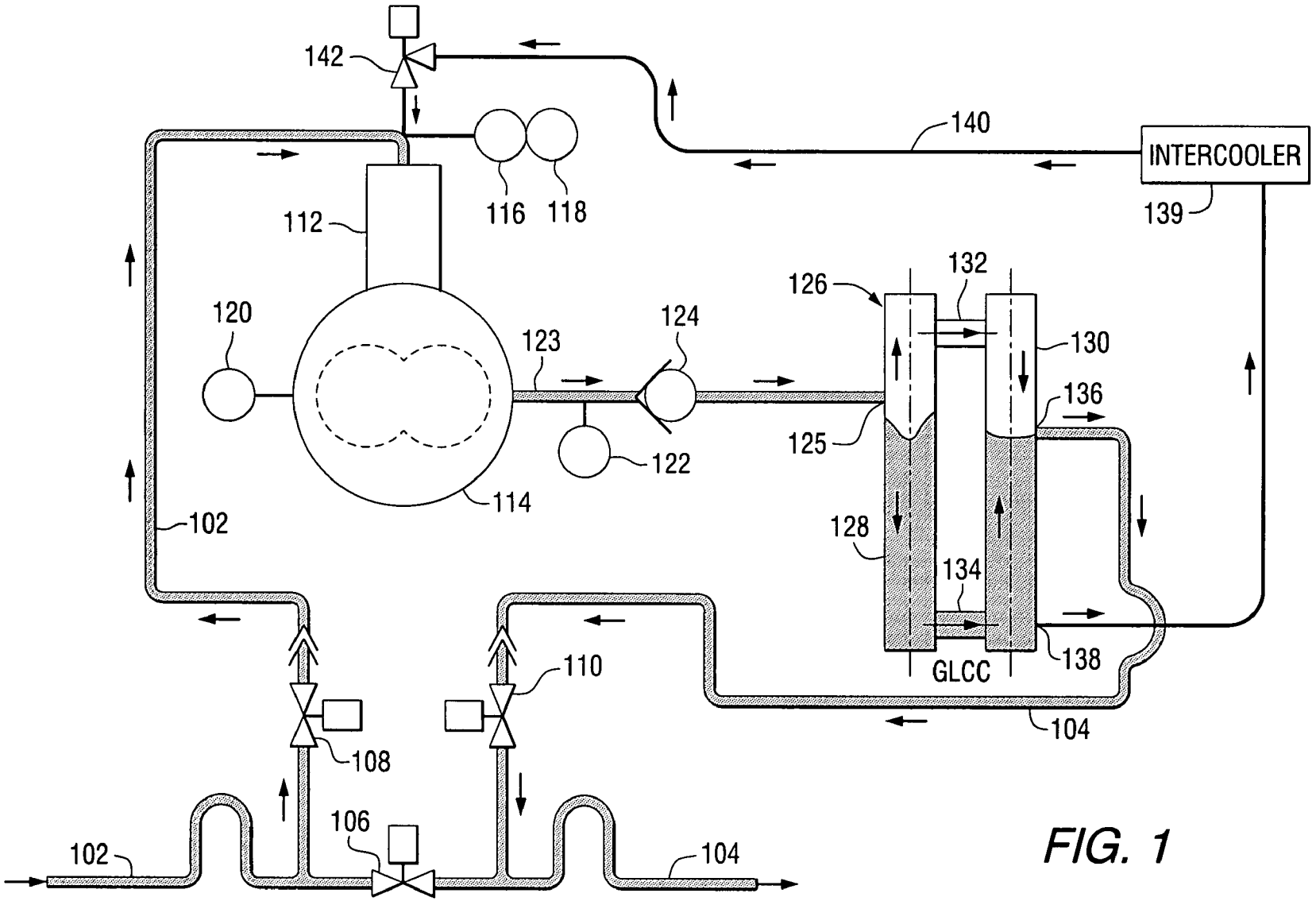
FIG. 1 provides a schematic overview of a subsea multiphase pumping system.

FIG. 1 broadly illustrates, in schematic form, a subsea multiphase pumping system in accordance with a presently preferred embodiment of the present invention. An inlet line (or well/manifold flow line) 102 leads to a production loop (to be described in more detail) while an outlet line (or production flow line) 104 leads out of this loop. Per convention, a bypass valve 106 may interconnect the inlet line 102 and the outlet line 104. Further, an admission valve 108 may be provided where the inlet line leads into the production loop and an outlet valve 110 may be provided where the outlet line leads out of the production loop.

Inlet line 102 preferably leads into a combination twin-screw pump and slug distributor in accordance with an embodiment of the present invention. Slug distributor 112, preferably positioned above pump 114, will be discussed in greater detail herebelow. Per convention, suction pressure and temperature transmitters 116/118, as well as discharge temperature and pressure transmitters, 120/122 may be provided as shown.

A connecting line 123 preferably leads from pump 114 to GLCC 126 via a check valve 124 and tangential inlet 125. GLCC 126, for its part (and in a manner better appreciated herebelow), includes a cyclonic column 128 and recombination column 130 per convention. These are interconnected at an upper region via gas connector 132 and a lower region via liquid connector 134. A recombination port 136 is disposed at a vertically intermediate point of recombination colunm 130, while towards a vertically lower portion there is preferably provided a recirculation port 138. Recombination port 136 accepts recombined gas and liquid and feeds into outlet line 104 while recirculation port 138 feeds into a recirculation line 140. Not shown within recombination column 130 is a baffle plate, which will be discussed in greater detail herebelow.

Recirculation line 140, for its part, feeds generally back into slug distributor 112 after passing through a choke valve 142 and past suction pressure and temperature transmitter. An intercooler 139 may optionally be provided (see discussion further below).

Figure 2:
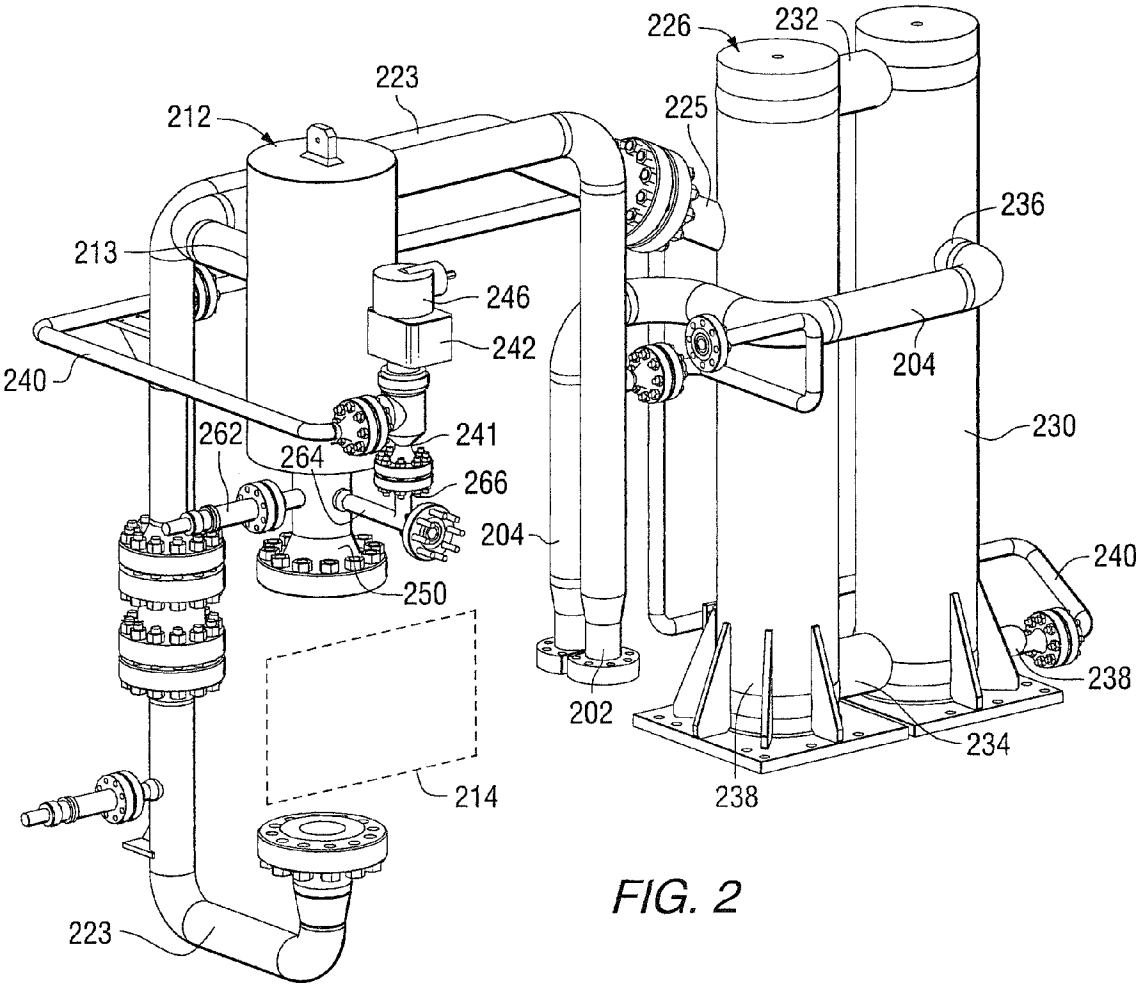
FIG. 2 is a perspective view of several components of a production loop in a subsea multiphase pumping system.

Having provided a basic framework for understanding and appreciating various embodiments of the present invention, FIG. 2 shows, in perspective view, several components of a production loop. FIGS. 3A-4D, on the other hand, show various components of the production loop from FIG. 2 in somewhat greater detail. It should be understood and appreciated that FIGS. 2-4D merely provide an illustrative and non-restrictive example of a production loop and, to the extent that the components in FIGS. 2-4D appear, or are oriented or positioned, differently from components in FIG. 1, those in FIG. 1 are merely shown in a highly stylized and schematic format for greater clarity. As such, components in FIG. 2-4D that are analogous to components in FIG. 1 bear reference numerals advanced by 100.

Figure 3C:
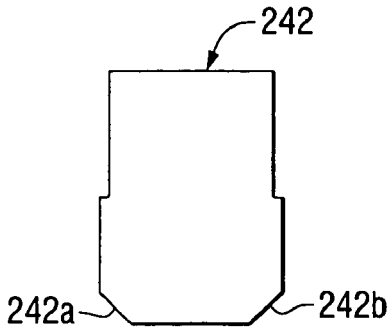
FIG. 3C is a cross-sectional plan view of a tangential inlet from FIG. 3A.
Figure 3B:
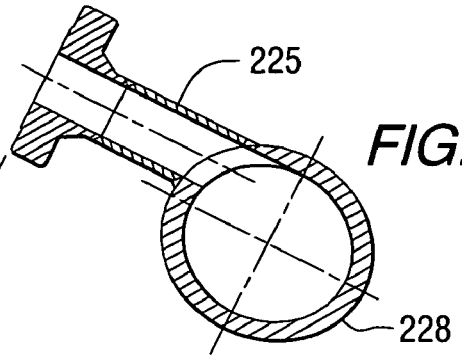
FIG. 3B is a side elevational view of a baffle in isolation.
Figure 3A:
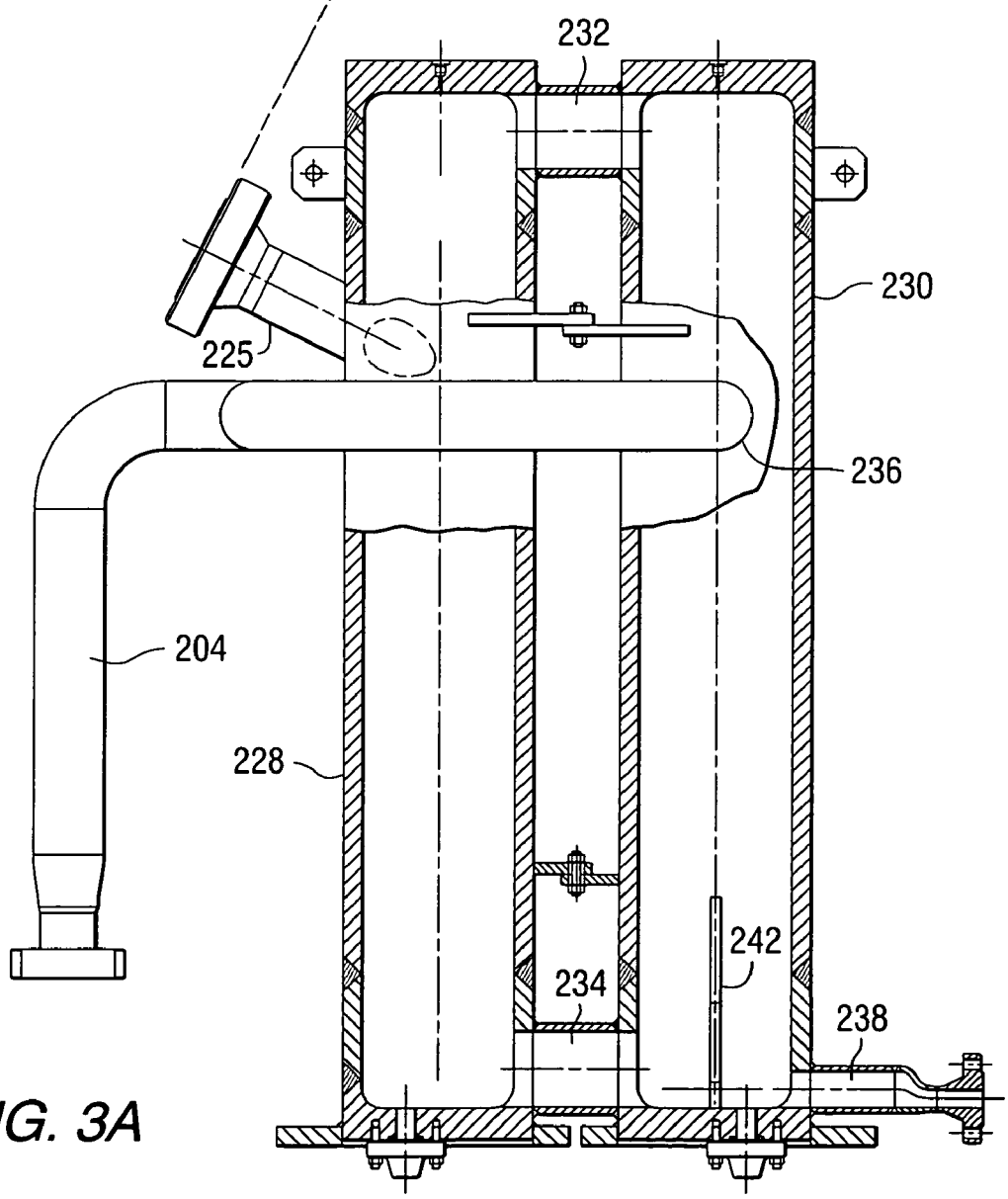
FIG. 3A is a cut-way elevational view of a GLCC from FIG. 2.

The discussion now turns to a GLCC 226 and related recirculation components in accordance with a preferred embodiment of the present invention. It should be understood that such a recirculation arrangement could be employed of its own merit in a subsea pumping system, or may be combined with a liquid slug distributor to be discussed in more detail further below. FIGS. 2 and 3A-3C may be referred to simultaneously in connection with the discussion presented below. As such, FIG. 3A is a cut-way elevational view of a GLCC from FIG. 2, while FIG. 3B is a cross-sectional plan view of a tangential inlet from FIG. 3A, and FIG. 3C shows a baffle in isolation.

As shown, and as conventionally known, connecting line 223 leads to a tangential inlet 225 in the form of a sloping inlet pipe. The "tangential" aspect of this inlet is characterized by its approach at a tangent to vertical cyclonic column 228. Thusly, the sloped inlet 225 begins a preseparation of the incoming fluid mixture into phases while at the point of tangential entry itself, a vortex is initiated within cyclonic column 228. As can be appreciated, centrifugal force will then tend to urge gas out of the incoming liquid.

As the gas and liquid separate from each other by way of the vortex just mentioned, the former will be urged upwardly and the latter, downwardly, by virtue of their relative specific gravities. Then, per convention, they will proceed to recombination colunm 230 via connectors 232 (for gas) and 234 (for liquid). Each of these connectors may include a flow meter to aid in measurement of the respective flow rates or flow volumes of gas and liquid.

Accordingly, recombination column 230 affords the capability of recombining the gas and liquid for transport, particularly, out of recombination port 236 and into outlet line 204. Known mathematical models typically take into account the piping between the cyclonic column 228 and the recombination port 236, whereby it is generally desired that a pressure equilibrium be established between the tangential inlet 225 and the recombination point 236. Normally, the liquid and gas connectors (or legs) 234/232 are typically made of the same diameter pipe, and differences in pressure losses through the liquid and gas connectors 234/232 are reconciled by appropriately choosing the height of the recombination port 236.

In accordance with a preferred embodiment of the present invention, the recombination column 230 is used for liquid inventory storage and can be similar in size to, or greater in diameter than, the cyclonic column 228. Whereas cyclonic column 228 is preferably sized (e.g., in diameter) to maximize the centrifugal forces in the fluid (albeit limited by erosion considerations), recombination column 230 is itself preferably sized to preserve the velocity of the liquid as it climbs up the column, so as to keep any and all particulates in suspension. This contrasts significantly with conventional GLCC's, where a cyclonic column is usually considerably greater in diameter than a recombination column (or than piping used in a recombination capacity).

Once the maximum vortex velocity is determined for a given capacity (again, erosion velocity limited) and the minimum flow rate in the vertical recombination column is selected (again, to keep particulates in suspension), it will be appreciated that the general storage capacity of GLCC 226 can also be tailored by the variable of the height of the columns 228/230. Continuity requires that taller columns still have the same vertical velocity as shorter ones; however, the total pressure loss through the GLCC is increased with taller liquid columns.

Indicated at 238 is an integrated recirculation port, in accordance with a preferred embodiment of the present invention. Port 238 is preferably located at a very low point of recombination column 230 so as to maximize available inventory in both columns 228/230 for recirculation. When there is no net liquid coming into the pump system at large, the liquid in GLCC 226 will drop below the level of the recombination port 236, eliminating the direct loss of liquid from the GLCC 226. Only liquid leaving port 236 in a gas phase would then be lost to the system.

As a particularly advantageous refinement, and as can best be appreciated from FIG. 3A, a baffle plate 242 is preferably included in the recombination column 230. The baffle plate 242 will essentially act to prevent entrained gas and particulates, that would be present in liquid entering from connector 234, from going directly to the recirculation port 238, thus preventing an inadvertent concentration of two constituents of the liquid phase that would be adverse for the pump (i.e., free entrained gas and particulates).

As such, it is to be recognized that recombination column 230 will preferably present a uniform distribution of gas and particulates across its diameter. In this connection, the baffle plate 242 will direct the particulates and gas with a vertical velocity before they are returned to the recirculation port 238. Since particulates have negative buoyancy, they will be urged downwardly to the recirculation port 238 at the concentrations typically found in the recombination column 230. On the other hand, any entrained gas will have net buoyancy and will continue to rise even from the portion of the liquid that is reversing direction to go to the recirculation port 238.

Preferably, the baffle 242 will not welded be at the bottom and, as shown in FIG. 3C, has chamfers 242*a/b* cut out on the lower corners. The chamfers 242*a/b* assist in fitting the baffle into recombination column 230 and also let liquid flow into the recirculation line 240 when there is no net liquid coming into the system; thus, when the liquid level falls below the top of the baffle 242 it can still flow to the recirculation line 240. At such times, gas carry under is not much of an issue given the low liquid velocities. When there is a lot of liquid flow and gas carry under is an issue, the liquid will tend to impinge on the baffle 242 and get diverted vertically upward, improving the separation of gas as described. Preferably, the baffle will be solid enough to divert the bulk of the flow but (via chamfers 242*a/b*) be "leaky" enough to avoid becoming a "dam" when there is only standing oil in the columns.

Though not essential, a heat exchanger or cooler could be included along the recirculation line between recirculation port 238 and any pump or slug distributor. This could be embodied, e.g., by a single coil, or pair of parallel coils, comprising relatively large diameter tubing; see, e.g., the intercooler 139 in FIG. 1.

Most preferably, liquid traversing recirculation line 240 will encounter a fluid resistor of some type to reduce the discharge pressure to the level of the pump suction pressure it will be "meeting", and preferably in a controlled manner. While such a resistor could be embodied by a laminar flow tube (which could double as a heat exchanger/intercooler) or a fixed resistor/orifice with a single stage or multiple orifices in series (e.g., made of tungsten carbide for erosion resistance, a variable resistor or choke valve may preferably be employed. A flow meter, indicated at 242 in FIG. 2 (in accordance with an embodiment where recirculation line 240 feeds into a slug distributor 212) can itself feed into a choke valve 246 as just described, wherefrom liquid flow then proceeds into distributor 212. In another variant, any of the options just mentioned could be coupled with a fast-acting shutoff valve (or, in the context of a choke valve, some type of fast-closing feature). As shown, a discharge connection 241 may preferably be provided at an underside of flow meter 242, to connect with a branch 266 of a discharge outlet 264 that extends from slug distributor 212.

It should be appreciated that a flow meter 242 will allow for a precise setting of choke valve 246. Additionally, the flow meter 242 would be able to detect any flow resistance change, to permit the choke valve (246) opening to be reset in compensation. Such resetting could be automatic (e.g. via feedback) or could be performed via manual controls (e.g. from a remote location). The particular arrangement chosen and employed can be governed by the parameters and context of the system at hand.

Though not shown, a fast-acting shut-off valve may also optionally be included in recirculation line 240. This could provide a measure of insurance in the event of pump motor shutdown, to avert leakage of recirculation liquid into pump suction that could otherwise be employed in a pump restart. In other words, the shut-off valve (or optionally a fast choke with good shut-off characteristics) would trap liquid in the GLCC 226 for use with the next restart. (As such, GLCC 226 may preferably be located above the pump suction so that liquid will tend to feed via gravity to the pump suction for a restart.)

Figure 4A:
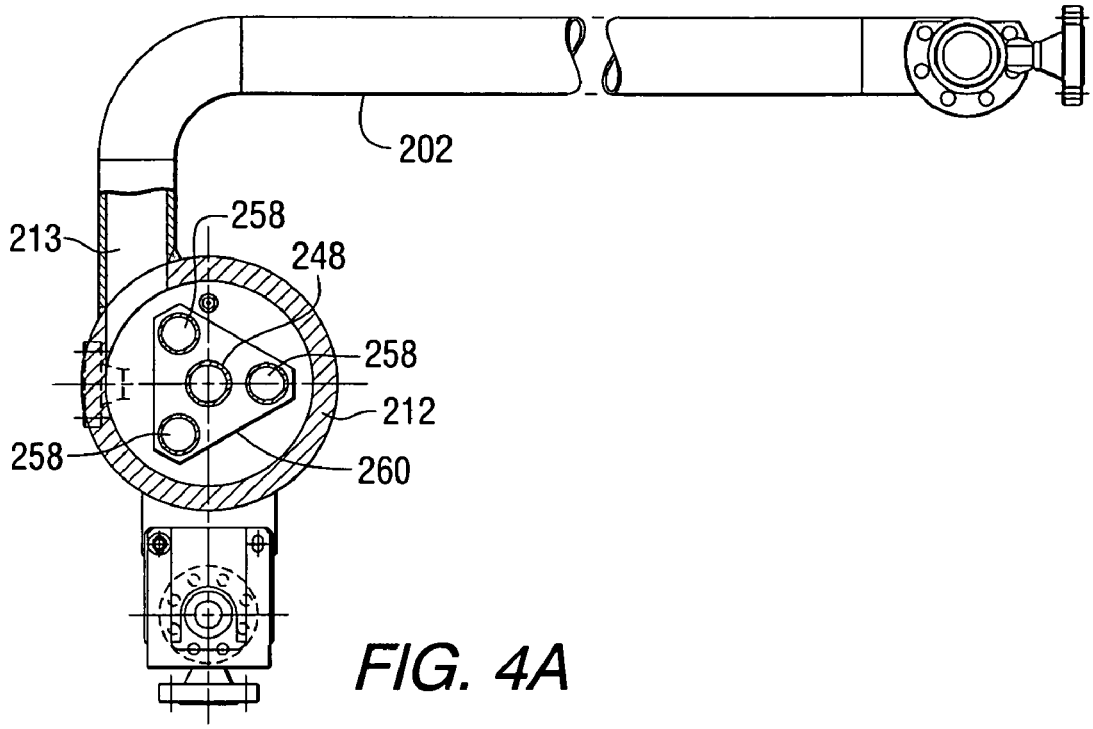
FIGS. 4A and 4B, respectively, are cut-away plan and elevational views of a liquid slug distributor from FIG. 2.
Figure 4B:
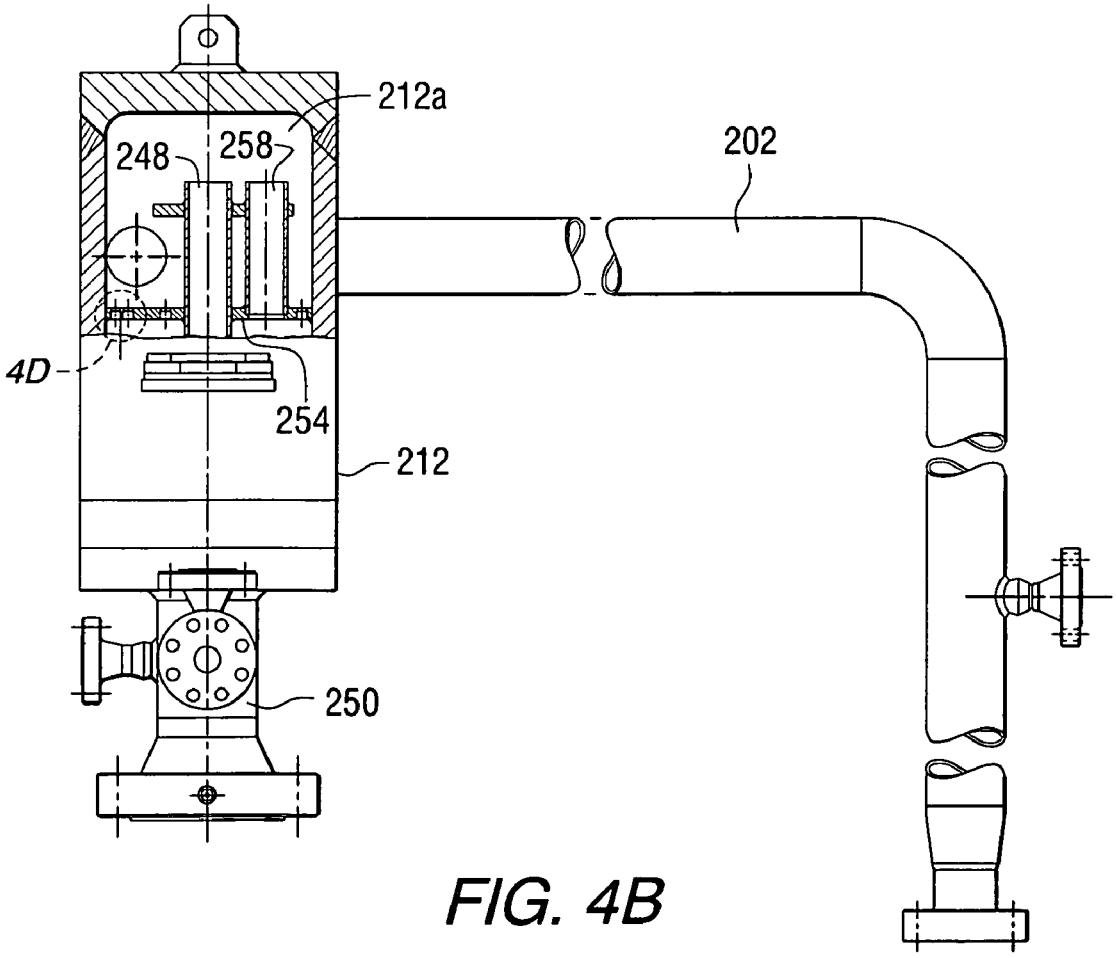
Figure 4C:
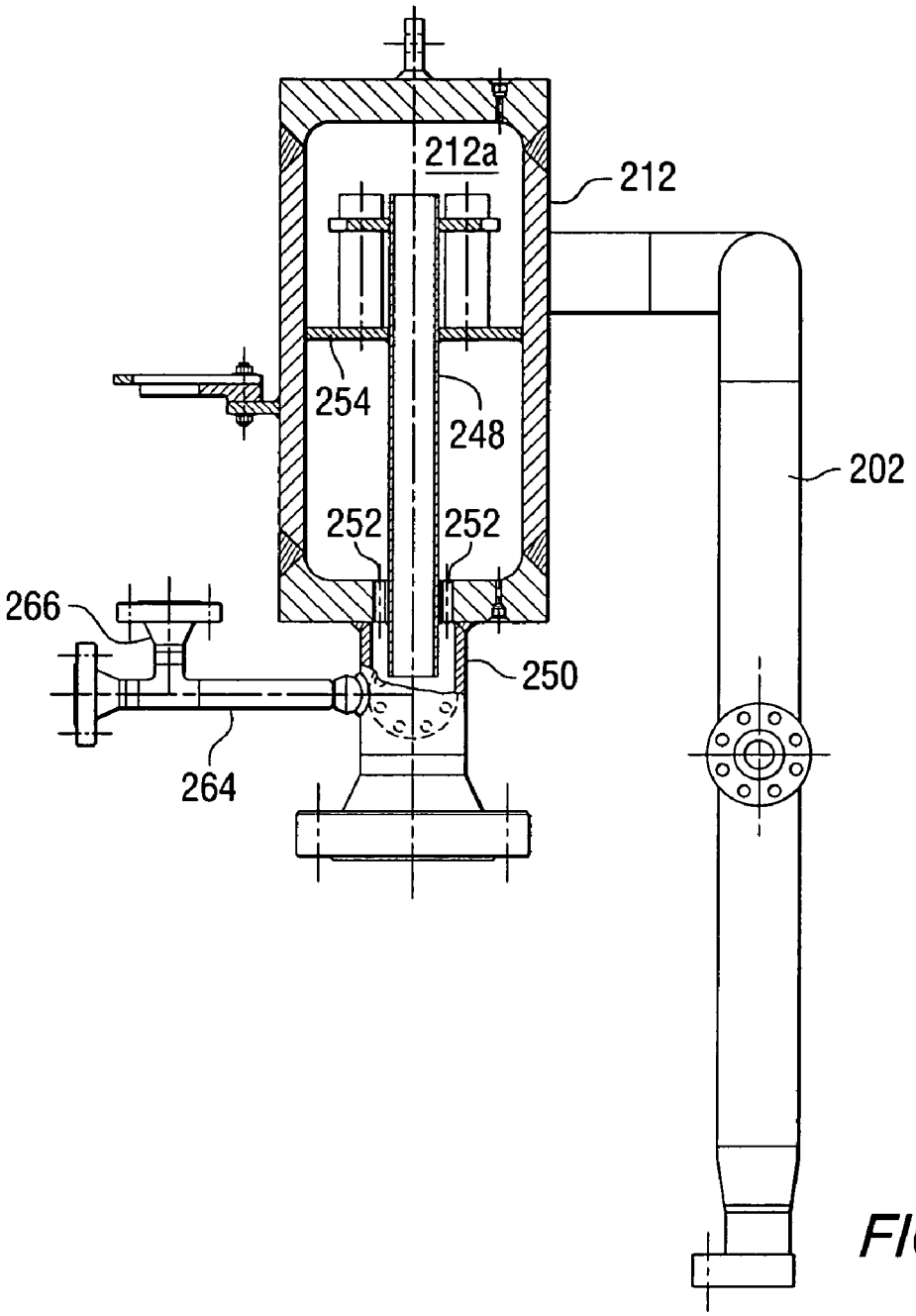
FIG. 4C is another cut-away elevational view of the liquid slug distributor of FIG. 4B.
Figure 4D:
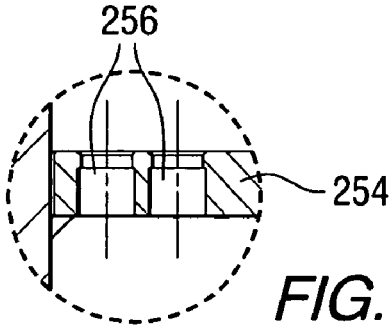
FIG. 4D is a close-up view of a perforated plate portion within dotted circle 4D from FIG. 4B.

The disclosure now turns to a discussion of a liquid slug distributor 212 in accordance with a preferred embodiment of the present invention. It should be understood and appreciated that a liquid slug distributor as broadly contemplated herein may be employed of its own merit or could be combined with a GLCC recirculation arrangement such as that just discussed. FIGS. 2 and 4A-4D may be referred to simultaneously in connection with the discussion presented below. As such, FIGS. 4A and 4B, respectively, are cut-away plan and elevational views of a liquid slug distributor from FIG. 2. FIG. 4C is another cut-away elevational view of the liquid slug distributor of FIG. 4B. FIG. 4D is a close-up view of a perforated plate portion within dotted circle 4D from FIG. 4B.

A liquid slug distributor 212, as shown, may preferably be embodied by a closed cylindrical vessel with its own tangential inlet 213, into which inlet line 202 leads. A "bowl" is essentially formed in the vessel via the installation of a standpipe 248 installed vertically in the center and extending through the bottom of the vessel; this may be thought of as a contained space (212*a*) defined about standpipe 248, through and over which incoming liquid describes a vortex. An outlet pipe 250 is located at the base of the cylinder, larger in diameter than the standpipe, and will lead to a pump (e.g., twin-screw pump) 214 (not shown but schematically indicated via dotted lines). The standpipe 248 feeds into outlet pipe 250.

Metering holes 252 of appropriate size penetrate the bottom of the bowl 212*a* in a circle surrounding the standpipe 248 but enclosed by the outlet pipe 250. (Here, six evenly distributed holes are provided.) This results in a recombination of the fluid flowing through the standpipe 248 with fluid passing through the metering holes 252. Additionally, a perforated plate 254 is preferably installed just below the level of the tangential inlet 213 and (as best appreciated by FIG. 4D) includes a plurality of throughholes or apertures 256. Perforated plate 254 serves to provide support for the standpipe 248 and also constitutes a location where agglomerations of wax can captured and inhibited; preferably, the size of throughholes 256 is such that any wax that does progress therethrough will not be sufficient to plug the preferably larger metering holes 252 and instead will simply be broken up and easily pass through the system.

Breather tubes 258, preferably three in number and distributed evenly about standpipe 248 as appreciated from FIG. 4A, extend through the perforated plate 254 and allow gas below the plate to pass to a higher space within the vessel where gas predominates and thence out via standpipe 248. As such, the tubes 258 thus allow liquid passing through the perforated plate 254 to displace gas accumulated below the plate 254 as liquid flows out through the metering holes 252 and the liquid level in the bowl. The tubes 258 allow the flow characteristic of the perforated plate 254 to be known by permitting the entire flow area associated with perforated plated 254 to be reserved for liquid flow, while tubes 258 are essentially reserved for gas; since liquid enters in a vertex, it will not enter tubes 258 so that liquid and gas flow will remain almost entirely separate. A simple diaphragm or web 260 preferably physically interconnects the breathing tubes 258 with standpipe 248 at an upper region of all of these, whereby further support and stability is imparted to the entire internal assembly.

The liquid storage capacity of slug distributor 212 is governed by its diameter and height, reduced by the diameter and height of the standpipe. The depth of a vortex caused by the flow through the tangential inlet 213 also reduces the stored capacity in the bowl 212*a*. The tangential velocity and centrifugal acceleration used to promote gas separation (and thus keep liquid in the bowl 212*a*) is determined by the flow rate, inlet pipe diameter and bowl diameter, while the tangential velocity of course needs to be limited by erosion concerns. The contributory forces causing liquid to flow through the metering holes 252 include the head of the liquid and the differential pressure generated by pressure accumulation caused by gas flow through the standpipe 248. Note that the liquid flow is not constant; it is greatest at the end of a liquid slug and the start of a gas slug. At such an instant, the liquid level is the greatest and the pressure accumulation resulting from gas flow through the standpipe 248 provides a pressure gradient between the upper surface of the liquid and the outlet 250.

It will be appreciated that the bowl size is a function of the period of the incoming slugs, the flow rate and the gas volume fraction. Thus, by way of an illustrative and non-restrictive practical example a flow rate of 500 $m^3$/hr (2200 gpm) with a gas volume fraction of 80% and a period of 3 seconds with a standard deviation of 1 second presents more than enough liquid to satisfy a continuous 5% or 25 $m^3$/hr (110 gpm) of liquid; the average liquid flow would be 100 $m^3$/hr (440 gpm). Preferably, the bowl will be configured to hold enough liquid to sustain a gas slug that is 9 seconds in length (3+6*Sigma), which is about 16.5 gallons after accounting for the reduction caused by the vortex.

In general, since pumps as employed herein typically operate at a fixed flow and speed, even when the liquid portion of a slug enters the distributor 212 the gas flow exiting though the standpipe 248 is the same as during the gas portion of the slug because the entering liquid displaces gas out of the bowl 212*a* and through the standpipe 248. In the event that the bowl 212*a* is filled, the metered flow is a function of the liquid level, the pressure accumulation due to gas flow and the flow coefficient of the metering holes. When the liquid level exceeds the height of the standpipe 248, the pressure accumulation in the standpipe 248 is slightly higher due to the presence of liquid flow, which is compensated for by the change in elevation from the inlet to the outlet. Calculations for the peak differential pressure and static head for these conditions can easily be performed, as can the average flow rates for each condition.

By way of additional components, two auxiliary connections 262 and 264 may extend outwardly from outlet 250 as shown. A branch 266 of outlet 264 may extend upward to meet the connection 241 discussed previously.

Outlet 262 may be a connection for a combined pressure and temperature transmitter of a type used subsea, with outlet 262 may be the combination point for incoming fluid and the recirculated fluid, with outlet 264 being the connection point for fluid from the GLCC that is being recirculated.

It is to be appreciated that while the GLCC recirculation arrangement and liquid slug distributor may each singly be incorporated into a general subsea multiphase pumping system of their own accord, there is contemplated in accordance with a particularly preferred embodiment of the present invention a very advantageous combination of the two. Each, on its own, can help ensure that a minimum liquid flow threshold (e.g. ~5% as already described) can be maintained. However, particular advantages are enjoyed when both arrangements are employed together.

On the one hand, the liquid slug distributor, on its own, may not be able to sustain operation if the loss of liquid exceeds a period equal to several standard deviations in the mean slug length. Additionally, it may not be able to provide sufficient flow assurance during start-up, at least until continuous periodic slug flow is achieved. On the other hand, the GLCC recirculation arrangement, on its own, may be able to support a loss of liquid of indefinite length (especially if a cooler or heat exchanger is employed) but reduces the volumetric efficiency of the process by consuming pump capacity while still requiring the power for full capacity at a given pump speed. The problem is aggravated by gas returning to the pump suction either as free gas or gas being liberated from solution when the liquid is restored to suction pressure. Typically the gas doubles the loss in pump capacity compared to the liquid required. The amount of gas returned is proportional to the amount of liquid being recirculated.

Accordingly, a combined system involving both arrangements is particularly well-geared towards optimizing pump operation. For its part, the GLCC recirculation arrangement system can provide continuous liquid flow in the face of long gas trains and even during startup where liquid sealing can permit the pump acting on gas in the production flow line to significantly lower the suction pressure of the flow line and consequently coax a well to start to flow. On the other hand, the liquid slug distributor vessel provides liquid flow assurance in steady-state conditions, making high rates of recirculation unnecessary. Instrumentation that may already be provided for pump operation and recirculation control and monitoring coupled with an appropriate operating strategy can achieve more optimal operation of the pump than possible with either system alone.

A general protocol for optimizing a composite liquid distribution/recirculation system, as broadly contemplated herein, can take the following form. For start-up and until steady state operation is achieved, recirculation can be provided at approximately 5% of pump total capacity. This quantity may be reduced for lower differential pressure during start-up; generally, the required recirculation rate will be a function of the screw outer diameter (in the twin-screw pump), the cube of the clearance and the square root of pump differential pressure. As a consequence, lower recirculation flow will be acceptable at lower differential pressures. Once steady state operation is achieved, the GVF (Gas Volume Fraction) being experienced by the pump, as well as the pump flow, can be estimated by the temperature rise across the pump and the pump speed and differential pressure; one will know in advance the specific heat of the liquid (water and petroleum) and the water cut (% of water in the liquid phase which increases as the well[s] age). In essence, as temperature rise increases (indicating high GVF), the higher the recirculation rate should be. For low temperature rise (indicating low GVF), the slug distributor alone would likely be sufficient, while for higher temperature rise more recirculation would be required.

In brief recapitulation, it will be appreciated that broadly embraced herein are systems and equipment that provide for good subsea installation and practice, by virtue of compactness, comparative low weight and freedom from intervention, as compared with topside installation. The issues of prime loss (though insufficient liquid) and pump overheating (because of fluid recirculation with a 100% gas inlet) become increasingly important as the pump boost pressure is increased in subsea contexts.

There are broadly contemplated herein, in accordance with at least one embodiment of the present invention, methods and arrangements providing continuous operation of a subsea multiphase pumping system, via boosting a multiphase petroleum stream via the use of a recirculation system. Also, the present invention, in accordance with at least one preferred embodiment, seeks to bring about distribution of unsteady liquid flow in a multiphase mixture into a more continuous minimum liquid flow. The distribution preferably occurs timewise, via averaging nearly square waves of liquid into a uniform flow.

In further recapitulation, it will be appreciated herein that the following, alone or in any combination, represent some examples of advantageous features associated with at least one presently preferred embodiment of the present invention: a recombination column may have an average diameter greater than or equal to an average diameter of a cyclonic column; a recombination column may have an average diameter sufficient for preserving liquid flow velocity to maintain particulates within liquid flow in suspension; and a baffle may extend across a major portion of a diametric dimension of a recombination column.

Without further analysis, the foregoing will so fully reveal the gist of the present invention and its embodiments that others can, by applying current knowledge, readily adapt it for various applications without omitting features that, from the standpoint of prior art, fairly constitute characteristics of the generic or specific aspects of the present invention and its embodiments.

If not otherwise stated herein, it may be assumed that all components and/or processes described heretofore may, if appropriate, be considered to be interchangeable with similar components and/or processes disclosed elsewhere in the specification, unless an express indication is made to the contrary.

If not otherwise stated herein, any and all patents, patent publications, articles and other printed publications discussed or mentioned herein are hereby incorporated by reference as if set forth in their entirety herein.

It should be appreciated that the apparatus and method of the present invention may be configured and conducted as appropriate for any context at hand. The embodiments described above are to be considered in all respects only as illustrative and not restrictive. All changes which come within the meaning and range of equivalency of the claims are to be embraced within their scope.

What is claimed is:

1. A multiphase pumping system for subsea operation, said system comprising:

a pump;

a flow inlet for accepting incoming multiphase flow and directing incoming multiphase flow generally towards said pump;

a flow outlet for directing outgoing multiphase flow generally away from said pump;

a flow management apparatus in fluid communication with said pump and at least one of said flow inlet and said flow outlet;

said flow management apparatus configured to ensure a minimum liquid content in multiphase flow entering said pump;

said flow management apparatus comprising:

a gas liquid cylindrical cyclone in communication with said flow outlet;

a recirculation port disposed in said gas liquid cylindrical cyclone; and a recirculation line in communication with said recirculation port, said recirculation line configured to direct flow generally towards said pump;

said gas liquid cylindrical cyclone comprising a cyclonic column, a recombination column and at least one conduit interconnecting said cyclonic column and said recombination column; and said recombination column having an average diameter sufficient for preserving liquid flow velocity to maintain particulates within liquid flow in suspension.

2. The system according to claim 1, wherein said recombination column has an average diameter greater than or equal to an average diameter of said cyclonic column.

3. A multiphase pumping system for subsea operation, said system comprising:

a pump;

a flow inlet for accepting incoming multiphase flow and directing incoming multiphase flow generally towards said pump;

a flow outlet for directing outgoing multiphase flow generally away from said pump;

a flow management apparatus in fluid communication with said pump and at least one of said flow inlet and said flow outlet;

said flow management apparatus configured to ensure a minimum liquid content in multiphase flow entering said pump;

said flow management apparatus comprising:

a gas liquid cylindrical cyclone in communication with said flow outlet;

a recirculation port disposed in said gas liquid cylindrical cyclone; and a recirculation line in communication with said recirculation port, said recirculation line configured to direct flow generally towards said pump;

said flow management apparatus further comprising an impeding device configured to impede at least a portion of liquid flow in advance of said recirculation port.

4. The system according to claim 3, wherein said impeding device is configured to maintain liquid in said gas liquid cylindrical cyclone sufficient for ensuring a minimum liquid content in multiphase flow entering said pump.

5. The system according to claim 4, wherein:

said gas liquid cylindrical cyclone comprises a cyclonic column, a recombination column and at least one conduit interconnecting said cyclonic column and said recombination column;

said impeding device and said recirculation port being disposed in said recombination column.

6. The system according to claim 5, wherein said recombination column has an average diameter sufficient for preserving liquid flow velocity to maintain particulates within liquid flow in suspension.

7. The system according to claim 6, wherein said recombination column has an average diameter greater than or equal to an average diameter of said cyclonic column.

8. The system according to claim 5, wherein:

said at least one conduit comprises a conduit interconnecting said cyclonic column and said recombination column at a lower portion of said cyclonic column and said recombination column;

said impeding device is interposed between said conduit and said recirculation port.

9. The system according to claim 8, wherein said recirculation port is disposed at a lowermost portion of said recombination column.

10. The system according to claim 5, wherein said impeding device comprises a baffle disposed at a lower portion of said recombination column.

11. The system according to claim 10, wherein said baffle extends across a major portion of a diametric dimension of said recombination column.

12. The system according to claim 11, wherein said baffle is shaped to permit limited liquid flow therepast below an uppermost portion of said baffle.

13. The system according to claim 12, wherein said baffle comprises chamfered corners at a lowermost portion of said baffle.

14. The system according to claim 3, further comprising an arrangement, in communication with said recirculation line, for providing heat exchange to ambient.

15. The system according to claim 14, wherein said arrangement for affording heat exchange comprises a coiled intercooler.

16. The system according to claim 3, further comprising an arrangement, in communication with said recirculation line, for limiting recirculation flow in advance of said pump.

17. The system according to claim 16, wherein said arrangement for limiting recirculation flow comprises a choke valve.

18. The system according to claim 17, wherein said arrangement for limiting recirculation flow further comprises a flow meter in communication with said choke valve.

19. The system according to claim 16, wherein said arrangement for limiting recirculation flow comprises a fast-acting shutoff valve.

20. The system according to claim 3, wherein:

said gas liquid cylindrical cyclone comprises a cyclonic column, a recombination column and at least one conduit interconnecting said cyclonic column and said recombination column; and said recombination column has an average diameter sufficient for preserving liquid flow velocity to maintain particulates within liquid flow in suspension.

21. The system according to claim 20, wherein said recombination column has an average diameter greater than or equal to an average diameter of said cyclonic column.

22. A multiphase pumping system for subsea operation, said system comprising:

a pump;

a flow inlet for accepting incoming multiphase flow and directing incoming multiphase flow generally towards said pump;

a flow outlet for directing outgoing multiphase flow generally away from said pump;

a flow management apparatus in fluid communication with said pump and at least one of said flow inlet and said flow outlet;

said flow management apparatus configured to ensure a minimum liquid content in multiphase flow entering said pump;

said flow management apparatus comprising:

a gas liquid cylindrical cyclone in communication with said flow outlet;

a recirculation port disposed in said gas liquid cylindrical cyclone; and a recirculation line in communication with said recirculation port, said recirculation line configured to direct flow generally towards said pump;

said gas liquid cylindrical cyclone comprising a recombination column; and said recirculation port is being disposed at a lowermost portion of said recombination column.

23. The system according to claim 22, wherein said pump comprises a twin-screw multiphase pump.

24. The system according to claim 22, wherein:

said gas liquid cylindrical cyclone further comprises a cyclonic column and at least one conduit interconnecting said cyclonic column and said recombination column; and said recombination column has an average diameter sufficient for preserving liquid flow velocity to maintain particulates within liquid flow in suspension.

25. The system according to claim 24, wherein said recombination column has an average diameter greater than or equal to an average diameter of said cyclonic column.

26. The system according to claim 22, wherein said flow management apparatus further comprises an impeding device configured to impede at least a portion of liquid flow in advance of said recirculation port.

27. The system according to claim 26, wherein said impeding device is configured to maintain liquid in said gas liquid cylindrical cyclone sufficient for ensuring a minimum liquid content in multiphase flow entering said pump.

28. The system according to claim 26, further comprising an arrangement, in communication with said recirculation line, for providing heat exchange to ambient.

29. The system according to claim 26, further comprising an arrangement, in communication with said recirculation line, for limiting recirculation flow in advance of said pump.

30. A multiphase pumping system for subsea operation, said system comprising:

a pump;

a flow inlet for accepting incoming multiphase flow and directing incoming multiphase flow generally towards said pump;

a flow outlet for directing outgoing multiphase flow generally away from said pump;

a flow management apparatus in fluid communication with said pump and at least one of said flow inlet and said flow outlet;

said flow management apparatus configured to ensure a minimum liquid content in multiphase flow entering said pump;

said flow management apparatus comprising:

a gas liquid cylindrical cyclone in communication with said flow outlet;

a recirculation port disposed in said gas liquid cylindrical cyclone; and a recirculation line in communication with said recirculation port, said recirculation line configured to direct flow generally towards said pump;

said flow management apparatus further comprising:

a liquid slug distributor;

said liquid slug distributor comprising an inlet and an outlet, said outlet being in communication with said pump;

said liquid slug distributor configured to regulate gas slugs incoming from said inlet in a manner to ensure propagation, through said outlet, of a minimum liquid content in multiphase flow.

31. The system according to claim 30, wherein said inlet of said liquid slug distributor is in communication with said recirculation line.

32. A multiphase pumping system for subsea operation, said system comprising:

a pump;

a flow inlet for accepting incoming multiphase flow and directing incoming multiphase flow generally towards said pump;

a flow outlet for directing outgoing multiphase flow generally away from said pump;

a flow management apparatus in fluid communication with said pump and at least one of said flow inlet and said flow outlet;

said flow management apparatus configured to ensure a minimum liquid content in multiphase flow entering said pump;

said flow management apparatus comprising:

a liquid slug distributor;

said liquid slug distributor comprising an inlet and an outlet, said outlet being in communication with said pump;

said liquid slug distributor configured to regulate gas slugs incoming from said inlet in a manner to ensure propagation, through said outlet, of a minimum liquid content in multiphase flow, said liquid slug distributor configured to limit the duration of predominantly gas slugs propagating into said outlet;

said liquid slug distributor further comprising a barrier dividing said interior chamber into upper and lower sub-chambers; and said barrier comprising throughholes for admitting a predetermined liquid flow profile between said upper and lower sub-chambers.

33. The system according to claim 32, wherein:

said liquid slug distributor comprises an interior chamber; and said inlet is configured for creating a vortex within said interior chamber.

34. The system according to claim 33, wherein said inlet comprises a tangential inlet.

35. The system according to claim 32, wherein:

said liquid slug distributor comprises metering holes for admitting a predetermined liquid flow profile from said lower sub-chamber to said outlet; and said throughholes are sized and disposed to break down paraffin in a manner to preclude blockage of said metering holes.

36. The system according to claim 35, wherein:

said liquid slug distributor further comprises a standpipe extending through said barrier between said upper and lower sub-chambers;

said standpipe comprising an inlet disposed above said inlet of said liquid slug distributor and an outlet which directs flow into said outlet of said liquid slug distributor.

37. The system according to claim 36, wherein said standpipe bypasses said metering holes in directing flow into said outlet of said liquid slug distributor.

38. The system according to claim 35, further comprising at least one breather tube in communication with said upper and lower sub-chambers.

39. The system according to claim 38, wherein said at least one breather tube extends from said barrier upwardly into said upper chamber.

40. The system according to claim 39, further comprising a support web interconnecting said standpipe and said at least one breather tube at upper portions of said standpipe and said at least one breather tube.

41. The system according to claim 32, wherein said pump comprises a twin-screw multiphase pump.

42. A gas liquid cylindrical cyclone for a multiphase pumping system for subsea operation, said gas liquid cylindrical cyclone comprising:

a recirculation port for communicating with a pump;

a cyclonic column;

a recombination column; and at least one conduit interconnecting said cyclonic column and said recombination column;

said recombination column having an average diameter sufficient for preserving liquid flow velocity to maintain particulates within liquid flow in suspension.

43. The gas liquid cylindrical cyclone according to claim 42, wherein said recombination column has an average diameter greater than or equal to an average diameter of said cyclonic column.

44. A gas liquid cylindrical cyclone for a multiphase pumping system for subsea operation, said gas liquid cylindrical cyclone comprising:

a recirculation port for communicating with a pump; and an impeding device configured to impede at least a portion of liquid flow in advance of said recirculation port.

45. The gas liquid cylindrical cyclone according to claim 44, wherein said impeding device is configured to maintain liquid in said gas liquid cylindrical cyclone sufficient for ensuring a minimum liquid content in multiphase flow entering a pump.

46. The gas liquid cylindrical cyclone according to claim 45, wherein:

said gas liquid cylindrical cyclone comprises a cyclonic column, a recombination column and at least one conduit interconnecting said cyclonic column and said recombination column;

said impeding device and said recirculation port being disposed in said recombination column.

47. The gas liquid cylindrical cyclone according to claim 46, wherein:

said at least one conduit comprises a conduit interconnecting said cyclonic column and said recombination column at a lower portion of said cyclonic column and said recombination column;

said impeding device is interposed between said conduit and said recirculation port.

48. The gas liquid cylindrical cyclone according to claim 44, further comprising: a cyclonic column;

a recombination column; and at least one conduit interconnecting said cyclonic column and said recombination column;

said recombination column having an average diameter sufficient for preserving liquid flow velocity to maintain particulates within liquid flow in suspension.

49. The gas liquid cylindrical cyclone according to claim 48, wherein said recombination column has an average diameter greater than or equal to an average diameter of said cyclonic column.

50. A gas liquid cylindrical cyclone for a multiphase pumping system for subsea operation, said gas liquid cylindrical cyclone comprising:

a recirculation port for communicating with a pump;

said gas liquid cylindrical cyclone comprises a recombination column; and said recirculation port is being disposed at a lowermost portion of said recombination column.

51. The gas liquid cylindrical cyclone according to claim 50, further comprising: a cyclonic column;

at least one conduit interconnecting said cyclonic column and said recombination column;

said recombination column having an average diameter sufficient for preserving liquid flow velocity to maintain particulates within liquid flow in suspension.

52. The gas liquid cylindrical cyclone according to claim 51, wherein said recombination column has an average diameter greater than or equal to an average diameter of said cyclonic column.

53. The gas liquid cylindrical cyclone according to claim 50, further comprising an impeding device configured to impede at least a portion of liquid flow in advance of said recirculation port.

54. The gas liquid cylindrical cyclone according to claim 53, wherein said impeding device is configured to maintain liquid in said gas liquid cylindrical cyclone sufficient for ensuring a minimum liquid content in multiphase flow entering a pump.

55. The gas liquid cylindrical cyclone according to claim 54, wherein:

said gas liquid cylindrical cyclone further comprises a cyclonic column and at least one conduit interconnecting said cyclonic column and said recombination column;

said impeding device and said recirculation port being disposed in said recombination column.

56. The gas liquid cylindrical cyclone according to claim 55, wherein:

said at least one conduit comprises a conduit interconnecting said cyclonic column and said recombination column at a lower portion of said cyclonic column and said recombination column;

said impeding device is interposed between said conduit and said recirculation port.

57. A liquid slug distributor for a multiphase pumping system for subsea operation, said liquid slug distributor comprising:

an inlet; and an outlet for communicating with a pump;

said liquid slug distributor configured to regulate gas slugs incoming from said inlet in a manner to ensure propagation, through said outlet, of a minimum liquid content in multiphase flow;

said liquid slug distributor configured to limit the duration of predominantly gas slugs propagating into said outlet;

said liquid slug distributor comprising an interior chamber;

said liquid slug distributor further comprising a barrier dividing said interior chamber into upper and lower sub-chambers; and said barrier comprising throughholes for admitting a predetermined liquid flow profile between said upper and lower sub-chambers.

58. The liquid slug distributor according to claim 57, wherein:

said inlet is configured for creating a vortex within said interior chamber.

59. A method of providing multiphase pumping in subsea operation, said method comprising:

providing a pump;

accepting incoming multiphase flow and directing incoming multiphase flow generally towards the pump;

directing outgoing multiphase flow generally away from the pump;

ensuring a minimum liquid content in multiphase flow entering the pump;

said step of ensuring a minimum liquid content comprising:

providing a gas liquid cylindrical cyclone; and recirculating at least a portion of liquid flow in the gas liquid cylindrical cyclone generally towards the pump;

step of ensuring a minimum liquid content further comprising:

providing a liquid slug distributor; and regulating gas slugs incoming into the liquid slug distributor in a manner to ensure propagation of a minimum liquid content in multiphase flow exiting out of the liquid slug distributor.

60. The method according to claim 59, wherein said recirculating step comprises recirculating at least a portion of liquid flow in the gas liquid cylindrical cyclone into the liquid slug distributor.

61. The method according to claim 60, wherein said recirculating step comprises:

providing continuous recirculation flow via the gas liquid cylindrical cyclone during pump startup and until steady state multiphase flow through the pump is achieved; and thereafter throttling recirculation flow from the gas liquid cylindrical cyclone.

* * * * *